US009829256B2

(12) United States Patent
Abels

(10) Patent No.: US 9,829,256 B2
(45) Date of Patent: Nov. 28, 2017

(54) HEAT EXCHANGER WITH ANNULAR INLET/OUTLET FITTING

(71) Applicant: Dana Canada Corporation, Oakville (CA)

(72) Inventor: Kenneth M. A. Abels, Oakville (CA)

(73) Assignee: Dana Canada Corporation, Oakville, Ontario (CA)

( * ) Notice: Subject to any disclaimer, the term of this patent is extended or adjusted under 35 U.S.C. 154(b) by 600 days.

(21) Appl. No.: 14/174,170

(22) Filed: Feb. 6, 2014

(65) Prior Publication Data

US 2014/0224452 A1 Aug. 14, 2014

Related U.S. Application Data

(60) Provisional application No. 61/762,412, filed on Feb. 8, 2013.

(51) Int. Cl.
*F28F 1/00* (2006.01)
*F28F 3/12* (2006.01)
(Continued)

(52) U.S. Cl.
CPC ..... *F28F 1/00* (2013.01); *F28D 9/005* (2013.01); *F28D 9/0037* (2013.01); *F28F 3/12* (2013.01); *F28F 9/0253* (2013.01)

(58) Field of Classification Search
CPC . F28F 1/04; F28F 1/045; F28F 9/0075; F28D 9/0031; F28D 9/0043; F28D 9/0062
See application file for complete search history.

(56) References Cited

U.S. PATENT DOCUMENTS 4,355,780 A * 10/1982 Bridgnell ..... F16F 15/06 248/675
4,436,147 A * 3/1984 Hudson, Jr. ..... F01N 3/043 165/164

(Continued)

FOREIGN PATENT DOCUMENTS

CN 1620588 A 5/2005
CN 101784861 A 7/2010

(Continued)

OTHER PUBLICATIONS

English Machine Translation of JP2011-075154A.

(Continued)

*Primary Examiner* — Frantz Jules
*Assistant Examiner* — Nelson Nieves
(74) *Attorney, Agent, or Firm* — Marshall & Melhorn, LLC

(57) ABSTRACT

A heat exchanger has first and second flow passages with a communication passage therebetween. An inlet/outlet opening in a wall of the first passage receives a one-piece inlet/outlet fitting having an inner tube and an outer ring connected by webs, the tube and ring defining inner and outer flow passages in direct flow communication with the first and second flow passages, respectively. A first end of the tube and an outer surface of the ring are provided with resilient sealing members for sealing within a bore of a coolant manifold. The ring has a planar sealing surface which is sealed to the wall of the first passage, and the second end of the inner tube extends through the first fluid flow passage and is sealed inside the communication passage. Lateral adjustment of the fitting within the inlet/outlet opening compensates for stack-up tolerance variation in the heat exchanger.

16 Claims, 8 Drawing Sheets

(51) Int. Cl.
*F28F 9/02* (2006.01)
*F28D 9/00* (2006.01)

(56) References Cited

U.S. PATENT DOCUMENTS 4,665,972 A 5/1987 Potier
4,977,954 A 12/1990 Potier et al.
5,203,384 A 4/1993 Hansen
5,551,506 A 9/1996 Nishishita
RE35,890 E 9/1998 So
6,196,306 B1 * 3/2001 Aikawa ..... F28D 1/0333 165/153
6,273,183 B1 * 8/2001 So ..... F28F 13/12 165/109.1
6,866,090 B2 * 3/2005 Takamatsu ..... F16L 39/005 165/154
7,021,670 B2 4/2006 Takasaki et al.
7,036,565 B2 * 5/2006 Brost ..... F28D 9/0043 165/103
8,231,143 B2 7/2012 Takasaki et al.
2001/0023760 A1 * 9/2001 Motzet ..... F23K 5/22 165/162
2003/0121649 A1 * 7/2003 Seiler ..... B21D 53/085 165/167
2003/0159807 A1 * 8/2003 Ayres ..... F28D 9/0043 165/81
2003/0192677 A1 * 10/2003 Rong ..... F28D 1/0341 165/109.1
2004/0188078 A1 * 9/2004 Wu ..... F28D 1/0325 165/183
2006/0005959 A1 * 1/2006 Maeda ..... B60H 1/00328 165/202
2007/0241560 A1 10/2007 Malone
2007/0267169 A1 * 11/2007 Acre ..... B60H 1/3227 165/42
2008/0047696 A1 * 2/2008 Sperandei ..... F28F 1/128 165/109.1
2008/0128114 A1 * 6/2008 Lai ..... G06F 1/20 165/80.4
2009/0000777 A1 * 1/2009 Wanni ..... F28D 9/0075 165/166
2009/0101326 A1 * 4/2009 Honzek ..... F28F 9/0246 165/186
2009/0126911 A1 * 5/2009 Shore ..... F28D 1/0325 165/109.1
2009/0159250 A1 * 6/2009 Cho ..... F28D 7/0041 165/167
2009/0229812 A1 * 9/2009 Pineo ..... F01M 5/00 165/297
2009/0266507 A1 * 10/2009 Turnbull ..... F28D 1/0325 165/11.1
2010/0096101 A1 * 4/2010 Braun ..... F02B 29/0462 165/41
2010/0200203 A1 * 8/2010 Postma ..... F28D 7/0041 165/177
2010/0276026 A1 * 11/2010 Powell ..... F16L 39/005 138/114
2011/0165033 A1 * 7/2011 Meschke ..... B01J 19/0093 422/211
2012/0090822 A1 * 4/2012 Francois ..... F28D 9/0006 165/170
2012/0132413 A1 * 5/2012 Cheadle ..... F01M 5/00 165/297
2013/0032319 A1 * 2/2013 Kinder ..... F28F 9/0246 165/170
2014/0251587 A1 * 9/2014 Persson ..... F28F 3/044 165/166
2014/0284033 A1 * 9/2014 Zima ..... F28F 3/08 165/166
2014/0374072 A1 * 12/2014 Seewald ..... F28D 1/0333 165/150
2014/0374076 A1 * 12/2014 Seewald ..... F28D 1/0333 165/166
2015/0285572 A1 * 10/2015 Fleitling ..... F28F 9/268 165/167

FOREIGN PATENT DOCUMENTS

JP 201175154 A 4/2011
WO 03/056264 7/2003
WO 2009/007065 1/2009

OTHER PUBLICATIONS

English Machine Translation of CN 1620588A as well as WO 03/056264A1 (related to CN 1620588A).
English Machine Translation of CN 101784861A as well as WO 2009/007065A1 (related to CN 101784861A).

* cited by examiner

HEAT EXCHANGER WITH ANNULAR INLET/OUTLET FITTING

CROSS-REFERENCE TO RELATED APPLICATION

This application claims priority to and the benefit of U.S. Provisional Patent Application No. 61/762,412 filed Feb. 8, 2013, the contents of which are incorporated herein by reference.

FIELD OF THE INVENTION

The invention relates to a heat exchanger with a combined inlet/outlet fitting having integral construction and providing enhanced sealing and alignment.

BACKGROUND

In the manufacture of heat exchangers, parts must be assembled with a high degree of precision to ensure reliable sealing and performance. In certain heat exchanger configurations assembly within required tolerances can be challenging, making it difficult to achieve reliable and accurate sealing and alignment of the two portions of the heat exchanger.

SUMMARY

According to an embodiment, there is provided a heat exchanger comprising: at least a first enclosed fluid flow passage and a second enclosed fluid flow passage, wherein each of the fluid flow passages is defined between a first wall and a second wall; first and second communication openings provided in the first wall of each of the first and second flow passages, wherein the first communication opening of the first flow passage aligns with the first communication opening of the second flow passage and the second communication opening of the first flow passage aligns with the second communication opening of the second flow passage; an inlet/outlet opening provided in the second wall of the first flow passage, wherein the inlet/outlet opening is aligned with the first communication opening in the first wall of the first flow passage; an inlet/outlet fitting received in the inlet/outlet opening, wherein the inlet/outlet fitting has an inner tubular passage surrounded by an outer annular passage, wherein the inner tubular passage is defined by an inner cylindrical tube having a first end and a second end, wherein the inlet/outlet fitting further comprises an outer annular ring having a first end and a second end, wherein the outer annular ring surrounds the inner cylindrical tube and is connected thereto, and wherein the outer annular passage is defined between the inner cylindrical tube and the outer annular ring; wherein the second end of the outer annular ring has a planar sealing surface surrounding the outer annular passage, and wherein the planar sealing surface of the outer annular ring is sealingly connected to an area of the second wall of the first flow passage surrounding the inlet/outlet opening, such that the first flow passage is in fluid flow communication with the outer annular passage of the inlet/outlet fitting; and wherein the second end of the inner cylindrical tube extends through the first flow passage and is in sealed fluid flow communication with the second flow passage, such that the second flow passage is in fluid flow communication with the inner tubular passage of the inlet/outlet fitting.

According to an embodiment, the first and second flow passages are defined by respective first and second plate pairs, each of the plate pairs comprising a pair of plates sealed together at their edges, and wherein the first plate includes the first wall and the second plate includes the second wall, and wherein the inlet/outlet opening is substantially concentrically aligned with the first communication openings in each of the first and second flow passages.

According to an embodiment, the first end of the inner cylindrical tube extends beyond the first end of the outer annular ring and has an outer surface provided with a resilient sealing member for sealing the first end of the inner cylindrical tube within a first inner bore of a fluid opening; and the outer annular ring has a cylindrical outer surface provided with a resilient sealing member for sealing the cylindrical outer surface of the annular ring within a second inner bore of said fluid opening, wherein the first inner bore and the second inner bore are concentric with one another. For example, the resilient sealing member of the outer annular ring and the resilient sealing member of the inner cylindrical tube may each comprise an O-ring.

According to an embodiment, the outer annular ring is integrally formed with the inner cylindrical tube, and the outer annular ring is rigidly connected to the inner cylindrical tube through a plurality of webs, such that the outer annular ring is concentric with the inner cylindrical tube.

According to an embodiment, the planar sealing surface of the outer annular ring has an annular shape, with an outer peripheral edge and an inner peripheral edge. Also, a diameter of the planar sealing surface at the outer peripheral edge may be greater than a diameter of the inlet/outlet opening, and a diameter of the planar sealing surface at the inner peripheral edge may be less than the diameter of the inlet/outlet opening. For example, the second end of the outer annular ring may comprise a shoulder located at the inner peripheral edge of the planar sealing surface and outwardly from the outer annular passage, wherein the shoulder has a diameter which is smaller than the diameter of the inlet/outlet opening, and is received inside the inlet/outlet opening. The diameter of the shoulder may differ from the diameter of the inlet/outlet opening by an amount which is at least as great as a stack-up tolerance variation of the heat exchanger.

According to an embodiment, the second end of the inner cylindrical tube has an outer cylindrical surface having a diameter which is less than a diameter of the first communication opening in the first wall of the first flow passage, and wherein the outer cylindrical surface of the tube is sealed to the first wall of the first flow passage. For example, the outer cylindrical surface of the inner cylindrical tube may be sealed to an inner peripheral surface of the first communication opening of the first flow passage, and/or may be sealed to the first wall of the first flow passage by brazing or welding.

According to an embodiment, the first wall of the first flow passage is in engagement with the first wall of the second flow passage, and wherein the first communication openings of the first and second flow passages are in substantial concentric alignment with one another. For example, the second end of the inner cylindrical tube may extend at least partially through the first communication opening in the first wall of the second flow passage, and/or the second end of the inner cylindrical tube may be sealed to the first wall of the second flow passage within the first communication opening of the second flow passage.

According to an embodiment, a space is provided between the first wall of the first flow passage and the first wall of the second flow passage, and a spacer may be provided in the space between the first wall of the first flow passage and the first wall of the second flow passage. The spacer may comprise: a hollow interior; a first end forming a sealed connection with the first wall of the first flow passage in an area surrounding the first communication opening of the first flow passage; and a second end forming a sealed connection with the first wall of the second flow passage in an area surrounding the first communication opening of the second flow passage. The spacer may comprise an annular ring having an inner cylindrical side wall, an outer cylindrical side wall spaced from the inner cylindrical side wall, and a bridging portion extending between and connecting the side walls together, wherein the inner cylindrical side wall, the outer cylindrical side wall and the bridging portion together define the hollow interior of the spacer. The cylindrical side walls and the bridging portion of the spacer may have a U-shaped appearance in cross-section, and wherein the second end of the spacer includes a shoulder which is received inside the first communication opening in the first wall of the second fluid flow passage. The spacer further comprises a resilient sealing member in the form of a sealing ring received inside the hollow interior. The first wall of the first flow passage may have an annular groove surrounding the first communication opening formed therein, and wherein the resilient sealing member has a first end received inside the annular groove and a second end received inside the hollow interior of the spacer, in engagement with the bridging portion.

BRIEF DESCRIPTION OF DRAWINGS

The invention will now be described, by way of example only, with reference to the accompanying drawings in which.

DETAILED DESCRIPTION

A heat exchanger 10 according to a first embodiment of the invention is described below with reference to FIGS. 1 to 7.

Figure 1:
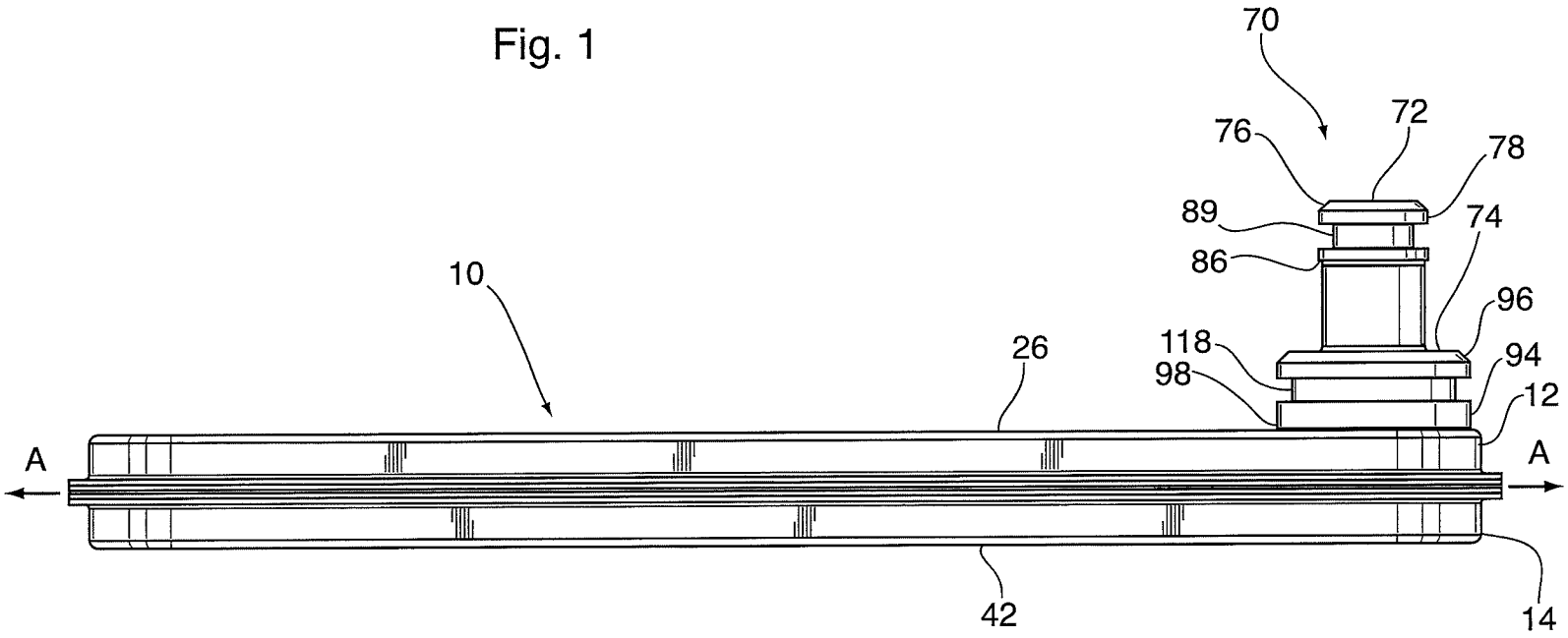
FIG. 1 is a side elevation view of a heat exchanger according to a first embodiment of the invention.

Heat exchanger 10 comprises a first portion 12 (the upper portion in FIG. 1) and a second portion 14 (the lower portion in FIG. 1). The first portion 12 of heat exchanger 10 defines a first enclosed fluid flow passage 20 (referred to herein as the "first flow passage"), wherein the first flow passage 20 is defined between a first wall 22 and a second wall 24. In the construction shown in the drawings, the first flow passage 20 is defined by a first plate pair 26 comprising a pair of plates 28, 30 sealed together at their peripheral edges, and wherein the first plate 28 includes the first wall 22 and the second plate 30 includes the second wall 24. In the first embodiment, the first wall 22 and the first plate 28 are flat and planar. The second plate 30 is shaped, with the second wall 24 forming a flat, planar plate bottom of the second plate 30, the second wall 24 being surrounded by a raised peripheral flange 32 having a peripheral sealing surface 34 along which the second plate 30 is sealingly joined to the first plate 28, for example by brazing or welding.

The second portion 14 of heat exchanger 10 similarly defines a second enclosed fluid flow passage 36 (referred to herein as the "second flow passage"), wherein the second flow passage 36 is defined between a first wall 38 and a second wall 40. In the construction shown in the drawings, the second flow passage 36 is defined by a second plate pair 42 comprising a pair of plates 44, 46 sealed together at their peripheral edges, and wherein the first plate 44 includes the first wall 38 and the second plate 46 includes the second wall 40. In the first embodiment, the first wall 38 and the first plate 44 are flat and planar. The second plate 46 is shaped, with the second wall 40 forming a flat, planar plate bottom of the second plate 46, the second wall 40 being surrounded by a raised peripheral flange 48 having a peripheral sealing surface 50 along which the second plate 46 is sealingly joined to the first plate 44, for example by brazing or welding.

As shown in the drawings, the first walls 22, 38 may be parallel to the respective second walls 24, 40, and the first and second flow passages 20, 36 may also be parallel to one another. In addition, it can be seen from the drawings that the heat exchanger 10 has a central longitudinal axis A which is parallel to a long dimension of the plate pairs 26, 42 and to the directions of fluid flow through the first and second flow passages 20, 36. The plate pairs 26, 42 are elongate and the flow passages 20, 36 extend from one end of the plate pairs 26, 42 to the other end thereof. Although not essential to the invention, the heat exchanger plates 28, 30, 44, 46 may be comprised of aluminum or an aluminum alloy.

Figure 2:
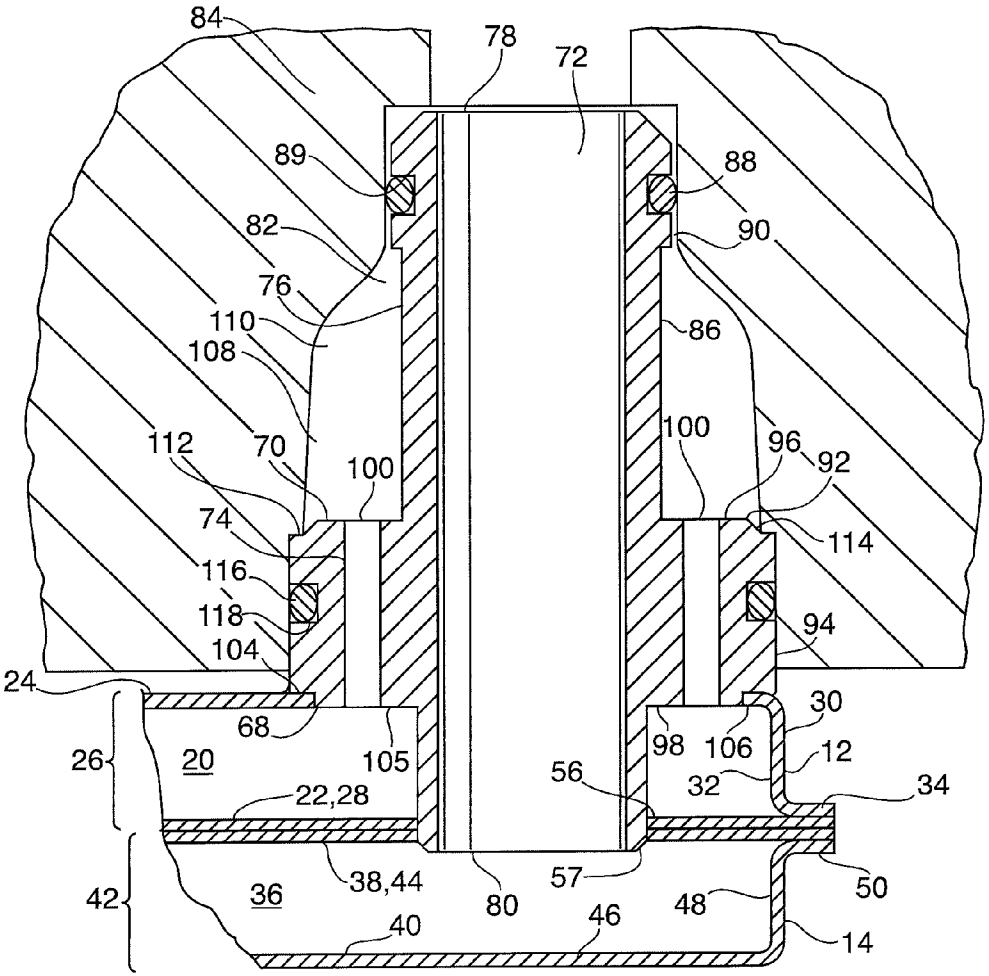
FIG. 2 is an enlarged, partial cross-section along the central longitudinal axis of the heat exchanger of FIG. 1, showing the fitting end of the heat exchanger.
Figure 3:
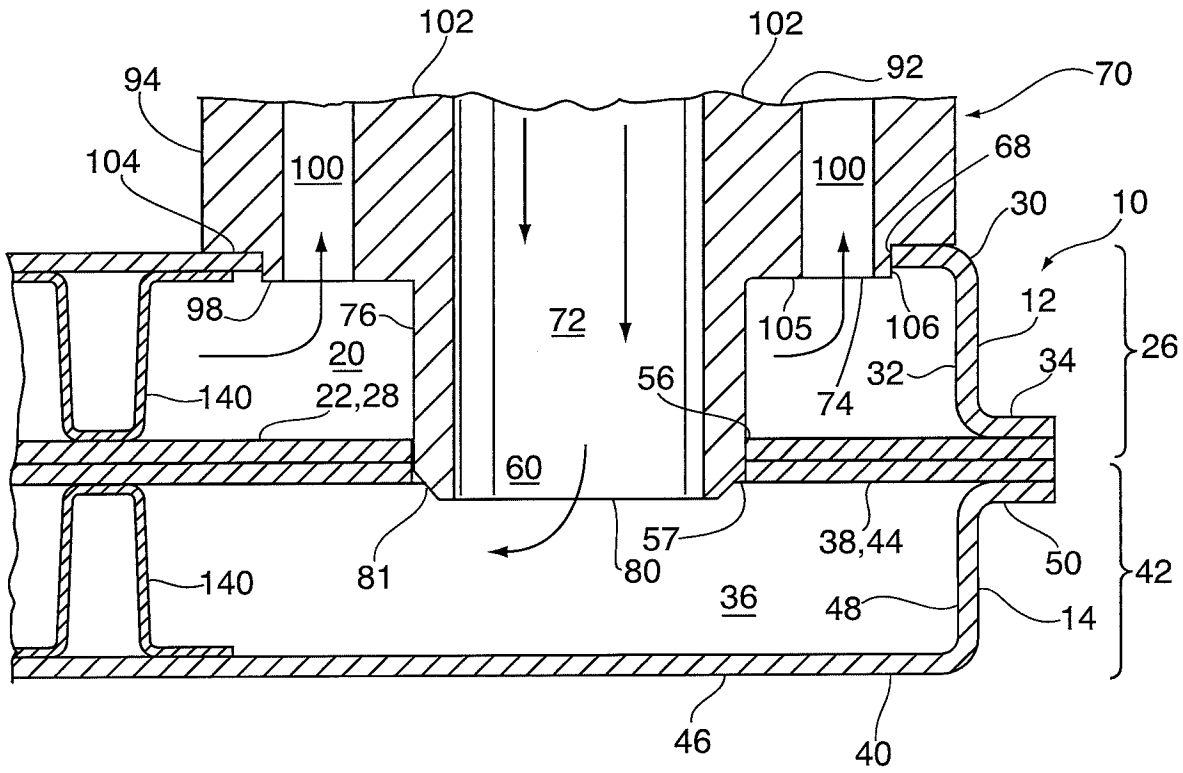
FIG. 3 is a further enlarged longitudinal cross-section similar to FIG. 2.
Figure 4:
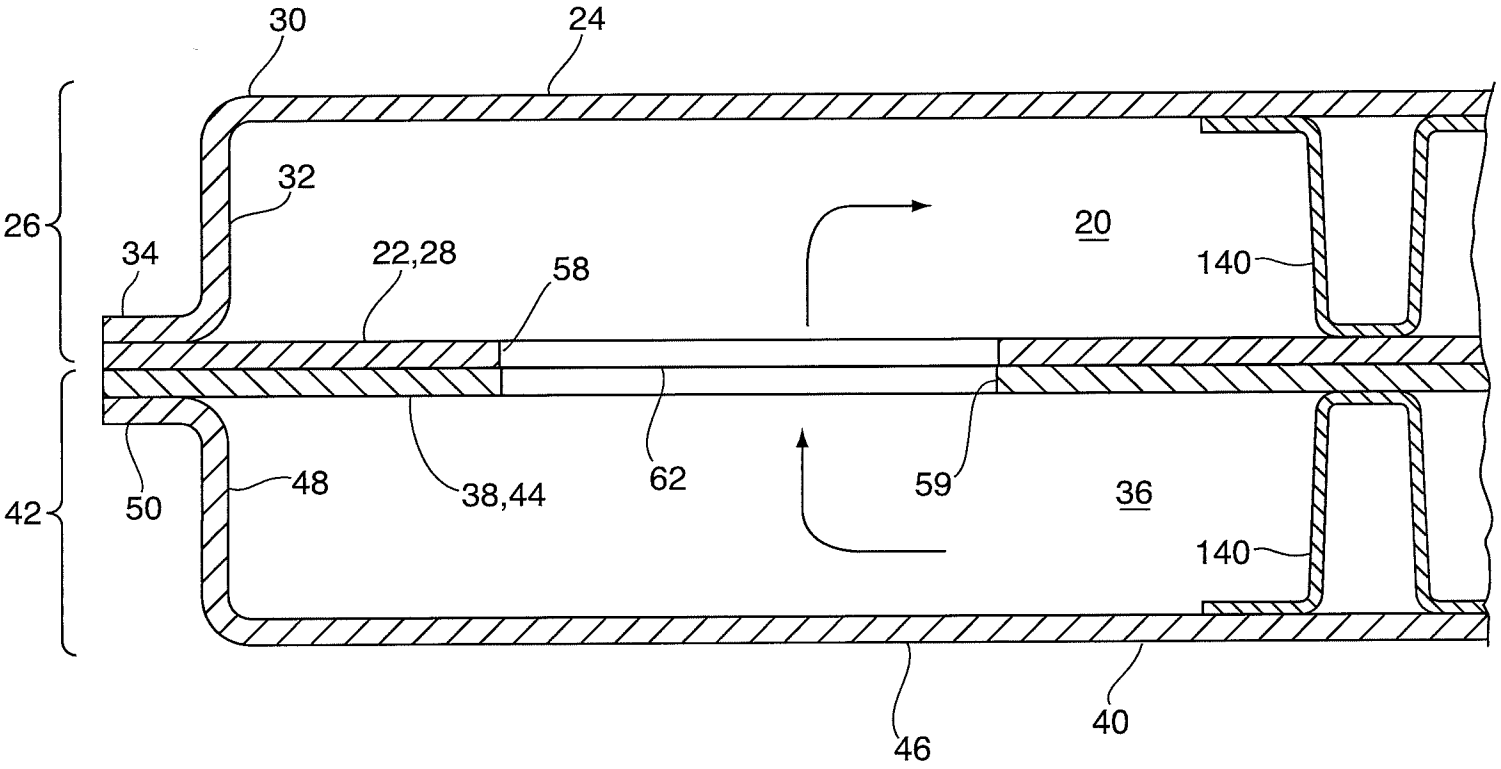
FIG. 4 is an enlarged, partial cross-section along the central longitudinal axis of the heat exchanger of FIG. 1, showing the end of the heat exchanger remote from the fitting.
Figure 6:
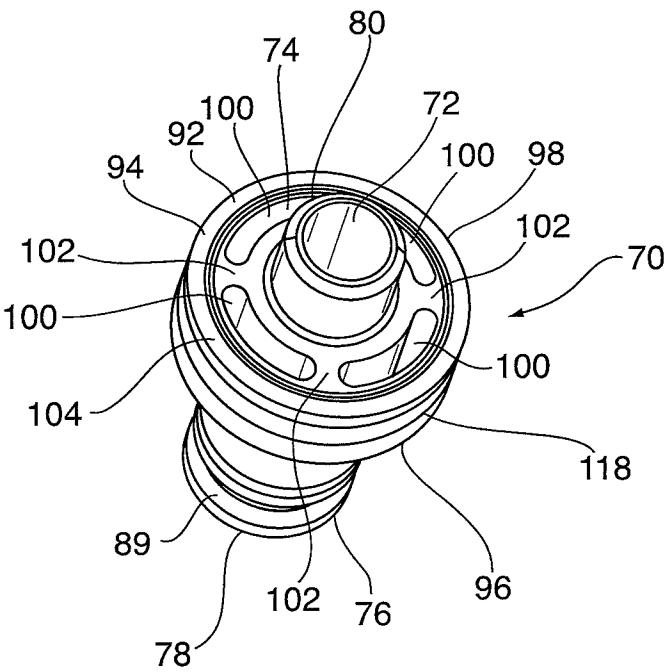
FIGS. 5 and 6 are respective front and rear perspective views showing an annular inlet/outlet fitting according to the invention in isolation.
Figure 5:
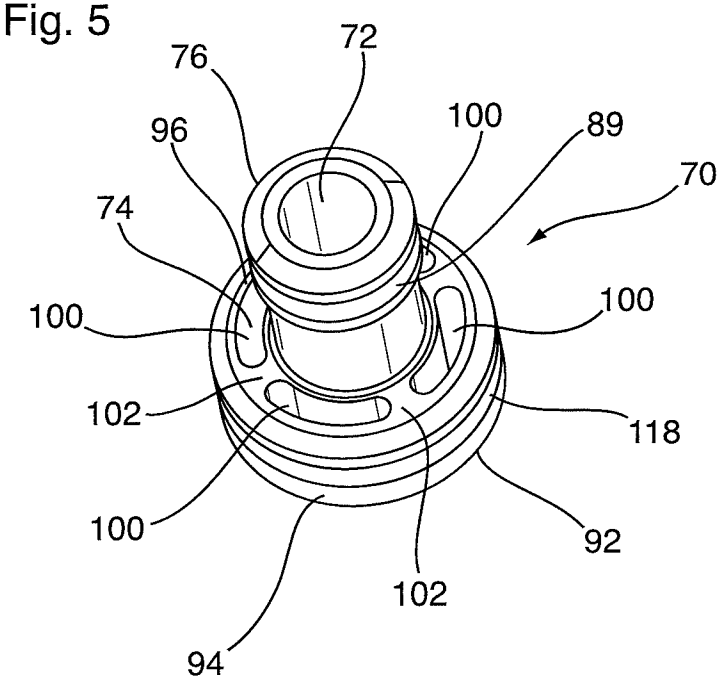

The first walls 22, 38 of the first and second flow passages 20, 36 are each provided with first and second communication openings. In this regard, the first and second communication openings of first wall 22 are labelled as 56 and 58, respectively, while the first and second communication openings of first wall 38 are labelled as 57 and 59, respectively. In this embodiment of the invention, the communication openings 56, 58 are located proximate to opposite ends of first wall 22, and the communication openings 57, 59 are located proximate to opposite ends of first wall 38. As shown in FIGS. 2 and 3, the first communication opening 56 provided in the first wall 22 of the first flow passage 20 aligns with the first communication opening 57 provided in the first wall 38 of the second flow passage 36, thereby forming a first communication passage 60 proximate to the fitting end of the heat exchanger 10. Also, as shown in FIG. 4, the second communication opening 58 in the first wall 22 of the first flow passage 20 aligns with the second communication opening 59 in the first wall 38 of the second flow passage 36, thereby forming a second communication passage 62 proximate to the end of the heat exchanger 10 which does not have a fitting.

An inlet/outlet opening 68 through which the liquid coolant enters and leaves the heat exchanger 10 is provided in the second wall 24 of the first fluid flow passage 20. As shown in the cross-sectional views of FIGS. 2 and 3, the inlet/outlet opening 68 is substantially concentrically aligned with the first communication opening 56 in the first wall 22 of the first fluid passage 20, with the first communication opening 57 in the first wall 38 of the second fluid passage 36 and also with the first communication passage 60, for reasons which will be explained below. Also, as shown in FIGS. 2 and 3, the inlet/outlet opening 68 has a diameter greater than that of the first communication openings 56, 57.

As can be appreciated from the above discussion, heat exchanger 10 may be assembled from a plurality of plates which may be joined together by brazing. As such, significant stack-up tolerance variation may be introduced during assembly of heat exchanger 10. The stack-up tolerance variation is the sum of a number of individual variations introduced during the manufacture, assembly and brazing of the components making up heat exchanger 10. For example, during manufacture of the components, there will be small variations in the sizes of openings 56, 58 and 68; and in the locations of the openings 56, 57, 58, 59 and 68 in the respective walls 22, 38 and 24. Because the openings 56, 57 and 68 are formed in different components, additional variations will be introduced during assembly and brazing. Therefore, there can be expected to be variations in the concentricity of the openings 56, 57 with each other, and with the inlet/outlet opening 68.

An inlet/outlet fitting 70 is received in the inlet/outlet opening 68. The inlet/outlet fitting 70 includes two flow passages for the coolant, namely an inner tubular flow passage 72 surrounded along a portion of its length by an outer annular flow passage 74. In the illustrated embodiment, the inner tubular flow passage 72 serves as the coolant inlet flow passage and the outer annular flow passage 74 serves as the coolant outlet flow passage. The inlet/outlet fitting 70 may be formed from a metal such as aluminum or an aluminum alloy, and is shown as having an integral, one-piece construction. The one-piece construction provides precise, concentric alignment between the inner flow passage 72 and the outer flow passage 74. In other words, the concentric orientation between the inner and outer flow passages 72, 74 is fixed due to the one-piece construction of the inlet/outlet fitting 70.

The inner tubular flow passage 72 is defined by an inner cylindrical tube 76 having a first end 78 located outside the heat exchanger 10 and which is adapted to seal to a fluid flow conduit, and a second end 80 located inside the heat exchanger 10. In use, the first end 78 of the inner cylindrical tube 76 will be sealingly received inside an opening 82 in a coolant manifold 84 containing coolant galleries. A portion of the manifold is shown in FIG. 2. As shown, the inner cylindrical tube 76 has an outer surface 86 which is provided with a resilient sealing member such as an O-ring 88 which sealingly engages a first inner bore 90 of the opening 82 in the coolant manifold 84. The O-ring 88 is retained within a circumferential groove 89 in the outer surface 86 of the inner cylindrical tube 76.

The outer annular flow passage 74 comprises an outer annular ring 92 having a cylindrical outer surface 94, a first end 96 and a second end 98. The annular ring 92 surrounds the inner cylindrical tube 76 along a portion of its length and is located between the first and second ends 78, 80 of the inner cylindrical tube 76, so that the ends 78, 80 of the inner cylindrical tube 76 extend from and project past the ends 96, 98 of the annular ring 92.

The outer annular ring 92 has a plurality of apertures 100 extending between the first and second ends 96, 98 of annular ring 92. Together, the apertures 100 define the outer annular passage 74. In the embodiment shown in the drawings, the apertures 100 extend parallel to the inner cylindrical tube 76 and the inner tubular passage 72. As best seen in the isolated views of FIGS. 5 and 6, the apertures may be somewhat kidney shaped in cross-section, however, it will be appreciated that the cross-sectional shape of the apertures 100 is not critical. The areas of the annular ring 92 between adjacent apertures 100 comprise webs 102 which rigidly connect the outer annular ring 92 to the inner cylindrical tube 76, and maintain a fixed, concentric orientation of the inner cylindrical tube 76 within the annular ring 92.

In use, the annular ring 92 of the inlet/outlet fitting 70 fits within a second inner bore 108 of the opening 82 in coolant manifold 84, as shown in FIGS. 2 and 3. The second inner bore 108 has a diameter greater than that of the first inner bore 90 and includes a manifold space 110 to receive the coolant from the outer annular passage 74. The outer surface 94 of outer annular ring 92 is provided with a resilient sealing member such as an O-ring 116 which sealingly engages the second inner bore 108 of the opening 82 in the coolant manifold 84. The O-ring 116 is retained within a circumferential groove 118 in the outer surface of annular ring 92. The second inner bore 108 may include an inwardly-extending shoulder 112 which engages an outer chamfered edge 114 of the first end 96 of annular ring 92 to prevent over-insertion of fitting 70 into opening 82 of manifold 84.

The opening 82 in coolant manifold 84 may be formed by machining, and can be expected to have precise dimensional tolerances. Therefore, the first and second bores 90, 108 can be expected to have a high degree of concentricity. Thus, in order to form a reliable seal, the sealing surfaces of the inner cylindrical tube 76 and annular ring 92 of fitting 70 must also have a high degree of concentricity. The inventors have found that the one-piece, rigid construction of the inlet/outlet fitting 70 achieves concentricity of the sealing surfaces with sufficient precision to reliably form seals with the bores 90, 108 of manifold 84.

At least a portion of the first end 96 of outer annular ring 92 may be flat and planar, as shown in the drawings, although this is not essential to the invention.

The second end 98 (i.e. lower end in FIGS. 2 and 3) of the outer annular ring 92 is formed with a planar outer portion, parallel to the first and second walls 22, 24, 38, 40, which provides an annular sealing surface 104 which sits on the outer surface of the second wall 24 of the first flow passage 20, and is sealed to second wall 24, for example by brazing or welding. The annular sealing surface 104 has an outer diameter at its outer peripheral edge which is greater than the diameter of the inlet/outlet opening 68, such that the annular sealing surface 104 engages and is sealed to the second wall 24 in an area surrounding the inlet/outlet opening 68. The annular sealing surface 104 is planar, and is perpendicular to both the inner cylindrical tube 76 and the outer annular ring 92, and to their sealing surfaces in which O-rings 88 and 116 are provided. Therefore, when annular sealing surface 104 engages the second wall 24 of heat exchanger 10, the annular sealing surface 104 sits flat on the second wall 24, to provide and maintain vertical orientation of the inlet/outlet fitting 70 during assembly and brazing. Precise vertical alignment of fitting 70 is important to ensure a reliable seal with the manifold, and the inventors have found that the provision of the planar, annular sealing surface 104 provides this alignment, while also maintaining a reliable (brazed or welded) seal with the second wall 24 of the first flow passage 20.

As shown in FIGS. 2 and 3, a shoulder 106 is located at the inner peripheral edge of the annular sealing surface 104. The shoulder 106 has a cylindrical shape and is angled at about 90 degrees relative to the annular sealing surface 104, having a vertical orientation in the views of FIGS. 2 and 3. The shoulder 106 and the inner peripheral edge of annular sealing surface 104 both have a diameter which is smaller than the diameter of the inlet/outlet opening 68, and thus the shoulder 106 fits inside the inlet/outlet opening 68 and helps to locate the inlet/outlet fitting 70 relative to the inlet/outlet opening 68 during assembly.

There is also a surface 105 extending inwardly from shoulder 106 to the inner tube 76. This surface 105 is shown as being flat and parallel to the annular sealing surface 104, although this is not essential. In the illustrated embodiment, the height of the shoulder 106 separating surfaces 104 and 105 is at least as great as the thickness of wall 24.

As shown in FIGS. 2 and 3, the second end 80 of the inner cylindrical tube 76 extends through the first fluid flow passage 20, such that the inner tubular passage 72 of the fitting 70 is in flow communication with the second fluid flow passage 36 via the first communication passage 60. The second end 80 of the inner cylindrical tube 76 is sealed to portions of wall(s) 22 and/or 38 in which the communication openings 56, 57 are formed, i.e. the inner peripheral surfaces of openings 56, 57, and/or those portions of wall(s) 22 and/or 38 immediately surrounding the openings 56, 57, the seal being formed by welding or brazing. In the illustrated embodiment, the first communication openings 56, 57 in walls 22, 38 have the same diameter, and the outer surface of tube 76 may be sealed to the inner peripheral surfaces of both openings 56 and 57, and/or portions of wall(s) 22 and/or 38 immediately surrounding the openings 56, 57.

It will be appreciated that the first communication opening(s) 56 and/or 57 may optionally be formed with upstanding flanges which extend along the outer surface of tube 76 and increase the sealing area between the tube and the first communication opening(s) 56 and/or 57. Alternatively, the second end 80 of inner cylindrical tube 76 may extend only partially through communication opening 56, or may not extend into communication opening 56 at all, so as to avoid any "tilting" of the fitting where, for example, the communication openings 56, 57 are misaligned with the inlet/outlet opening 68. Tilting of the fitting 70 will cause the fitting to deviate from its vertical orientation, which may affect the seal between fitting 70 and manifold 84. In addition, tilting of fitting 70 may also affect the seal between the annular sealing surface 104 and wall 24.

The second end 80 of the inner cylindrical tube 76 may have a chamfered tip 81 (FIG. 3) to ease insertion of the tube 76 in the first communication passage 60. However, this is not necessary in all embodiments, for example in cases where there is little or no insertion of the second end 80 of inner cylindrical tube 76 into communication passage 60 or communication openings 56, 57. In other embodiments, the outer surface of tube may be sealed to only one of the openings 56 or 57, with one of the other one of the openings 56 or 57 being of a slightly larger diameter so that its inner peripheral surface is spaced from the outer surface of tube 76.

Figure 3A:
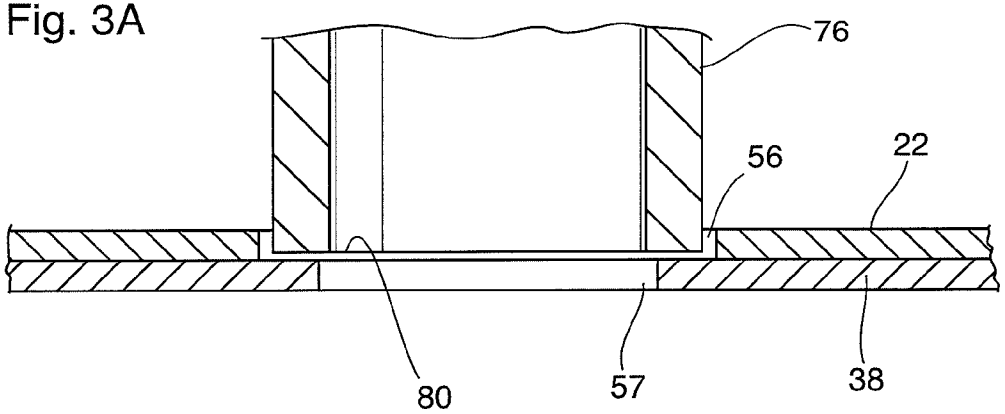
FIGS. 3A and 3B are enlarged, partial cross-sections showing alternate sealing arrangements at the second end of the inner cylindrical tube of the inlet/outlet fitting.
Figure 3B:
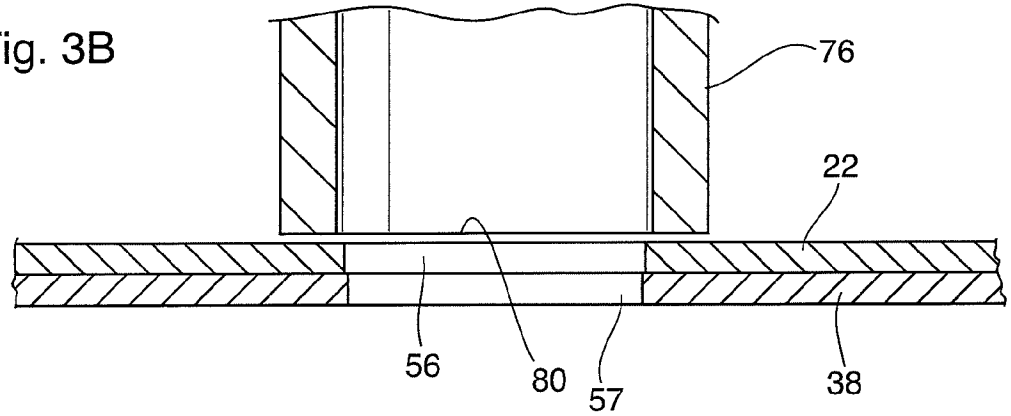

FIGS. 3A and 3B show alternate arrangements of the second end 80 of inner cylindrical tube 76 and openings 56, 57, which would be expected to help avoid angular misalignment of the fitting 70.

For example, FIG. 3A shows communication opening 56 of wall 22 being of larger diameter than communication opening 57 of wall 38. In this embodiment, the second end 80 of inner cylindrical tube 76 has a smaller diameter than opening 56 but a larger diameter than opening 57. The second end 80 is shown as extending into opening 56. It will be appreciated that the gaps between second end 80 of tube 76 and the openings 56 and 57 will become filled with a braze or weld fillet, to provide a seal at the end 80 of tube 76.

FIG. 3B shows a further alternate arrangement in which the second end 80 of the inner cylindrical tube 76 has a larger diameter than the openings 56, 57 in respective walls 22, 38. The openings 56, 57 are of substantially the same diameter. In this embodiment, a braze or weld joint will be provided between the end 80 of tube 76 and the surface of wall 22 surrounding opening 56. Again, the gap between end 80 of tube 76 and wall 22 will be sealed by a weld or braze fillet.

As mentioned above, the heat exchanger 10 will have a significant stack-up tolerance variation, while the concentric alignment of the inner tube 76 and outer annular ring 92 of the inlet/outlet fitting 70 is fixed. Therefore, in order to achieve reliable seals between the fitting 70 and the remainder of heat exchanger 10, the difference in diameter between shoulder 106 and opening 68 must be at least as great as the amount of misalignment of openings 56, 57 and 68 caused by the stack-up tolerance variation mentioned above. In this way, the inlet/outlet fitting 70, with its precisely aligned inner tube 76 and annular ring 92, can form reliable seals with the area of wall 24 surrounding opening 68, and with the inner peripheral surface(s) of openings 56 and/or 57, regardless of any misalignment between opening 68 and openings 56 and/or 57 caused by the stack-up tolerance variation.

Figure 7:
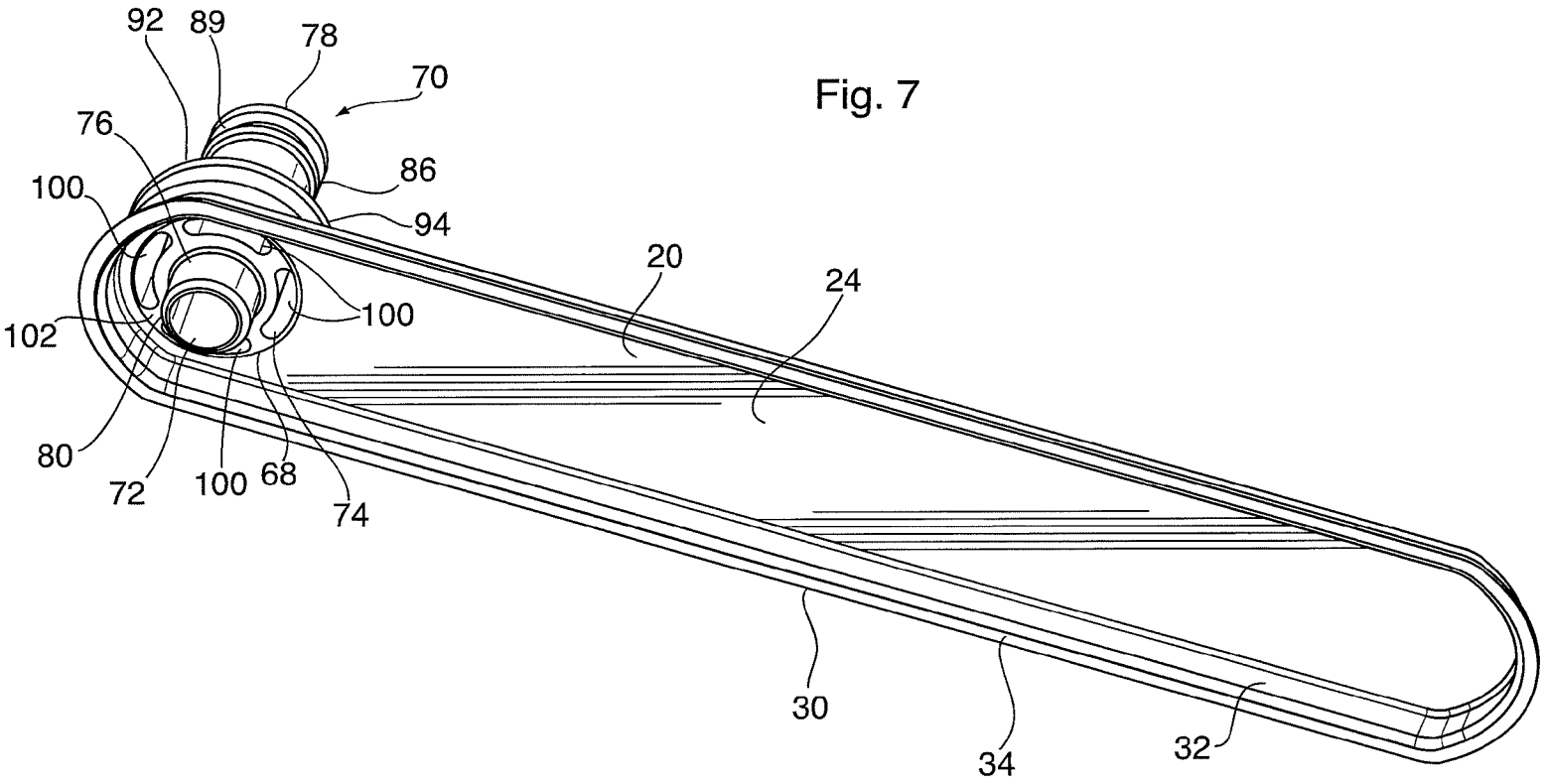
FIG. 7 is a bottom perspective view showing the annular inlet/outlet fitting and a heat exchanger plate according to the invention.

As can be seen in FIGS. 2, 3 and 7, the apertures 100 in the outer annular ring 92 are spaced radially inwardly from the annular sealing surface 104 and the shoulder 106, such that the apertures 100 and the resulting outer annular passage 74 are in full fluid communication with the first flow passage 20. Thus, the coolant exits the heat exchanger 10 by flowing from the first flow passage 20 into the outer annular passage 74 of fitting 70.

As mentioned above, the second end 80 of the inner cylindrical tube 76 and the inner tubular passage 72 of the inlet/outlet fitting 70 extend completely through the first flow passage 20 so that the liquid coolant entering the heat exchanger 10 through the inner tubular passage 72 bypasses the first flow passage 20 and flows directly into the second flow passage 36. In order for the coolant entering heat exchanger 10 to bypass the first flow passage 20, the inner tubular passage 72 and the inner cylindrical tube 76 are in substantially sealed flow communication with the second flow passage 36. Thus, it can be seen that the first communication passage 60 provides direct communication between the inner tubular passage 72 of the inlet/outlet fitting 70 and the second flow passage 36.

In use, the liquid coolant from coolant manifold 84 enters the heat exchanger 10 through the inner tubular passage 72 of inlet/outlet fitting and flows directly into the second flow passage 36. The coolant then flows axially to the opposite end of the heat exchanger 10, flowing from the second flow passage 36 to the first flow passage 20 through the second communication passage 62. The coolant then flows back toward the inlet/outlet opening 68 and enters the outer annular passage 74 of the inlet/outlet fitting 70, from where it flows back into the coolant manifold 84. Thus, the coolant makes two passes through heat exchanger 10. It will be appreciated that the flow through heat exchanger 10 may be reversed, such that the coolant enters heat exchanger 10 through the outer annular passage 74 and exits the heat exchanger through the inner tubular passage 72.

As shown in FIGS. 3 and 4, the first and second flow passages 20, 36 may be provided with turbulence-enhancing inserts 140, each of which may comprise a fin or a turbulizer. As used herein, the terms "fin" and "turbulizer" are intended to refer to corrugated turbulence-enhancing inserts having a plurality of axially-extending ridges or crests connected by side walls, with the ridges being rounded or flat. As defined herein, a "fin" has continuous ridges whereas a "turbulizer" has ridges which are interrupted along their length, so that axial flow through the turbulizer is tortuous. Turbulizers are sometimes referred to as offset or lanced strip fins, and example of such turbulizers are described in U.S. Pat. No. Re. 35,890 (So) and U.S. Pat. No. 6,273,183 (So et al.). The patents to So and So et al. are incorporated herein by reference in their entireties.

Figure 8:
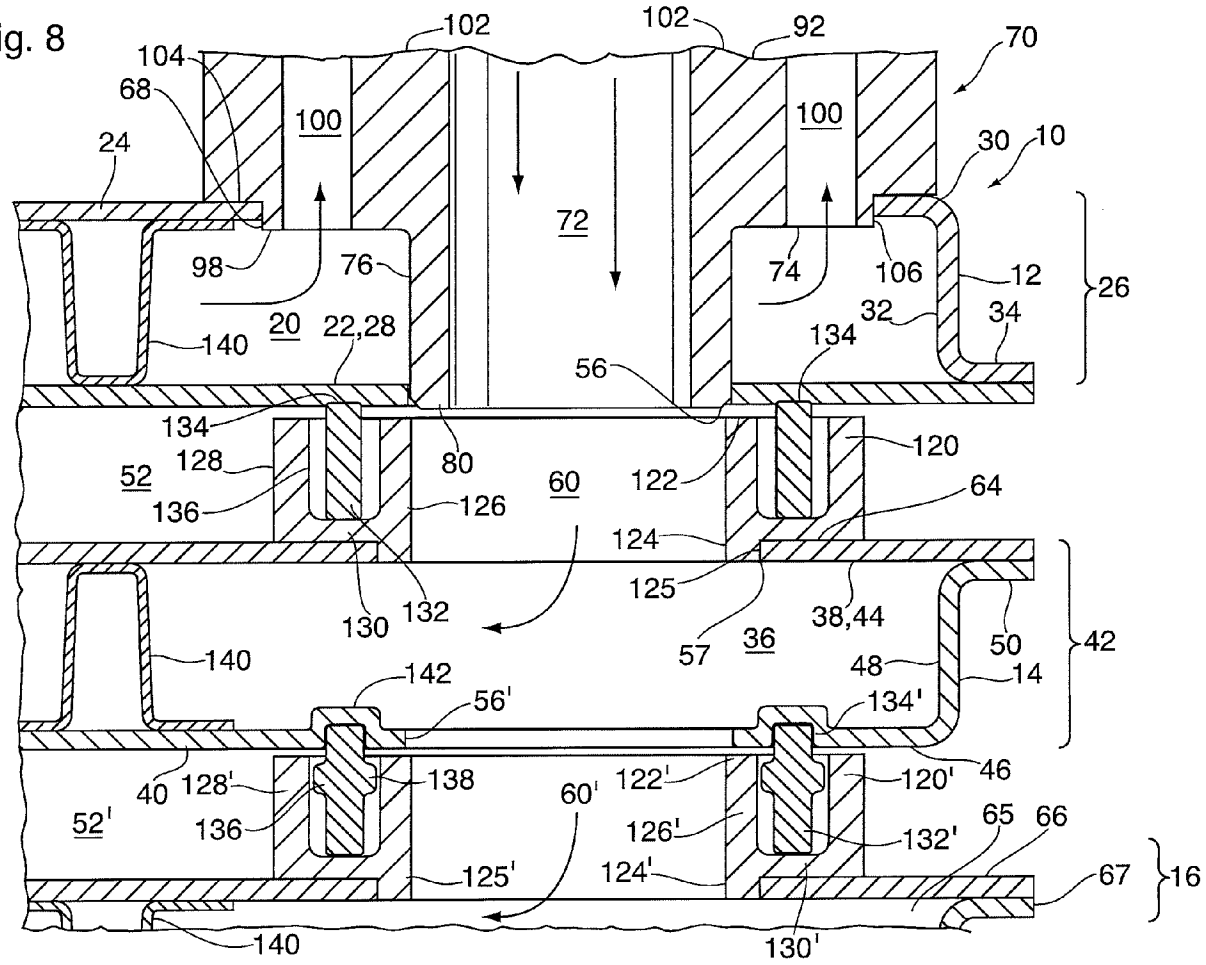
FIG. 8 is an enlarged, partial cross-section along the central longitudinal axis of a heat exchanger according to a second embodiment, showing the fitting end of the heat exchanger.

A heat exchanger 200 according to a second embodiment of the invention is illustrated in FIG. 8. Many of the components of heat exchanger 200 are similar or identical to the components of heat exchanger 10 described above, and the above description of heat exchanger 10 applies to heat exchanger 200, except as noted below.

Heat exchanger 200 differs from heat exchanger 10 in that heat exchanger 200 includes: first portion 12 comprising a first fluid flow passage 20 defined between walls 22, 24; a second portion 14 comprising a second fluid flow passage 36 defined between walls 38, 40; and third portion 16 comprising a third fluid flow passage 65 defined between walls 66, 67 (wall 67 not shown in FIG. 8). It will be appreciated that the heat exchanger 200 may include more than three portions, or may include only two portions 12 and 14.

Also, the portions 12, 14, 16 of heat exchanger 200 are spaced apart, with a space 52 provided between the first and second portions 12, 14, and a space 52' provided between the second and third portions 14, 16. More specifically, a first space 52 is provided between wall 22 of the first fluid flow passage 20 and wall 38 of the second fluid flow passage 36. Similarly, a second space 52' is provided between wall 40 of the second fluid flow passage 36 and wall 66 of the third fluid flow passage 65.

In this embodiment, the first communication openings 56, 57 of walls 22, 38 are substantially concentrically aligned, with the first communication passage 60 extending across the first space 52 provided between walls 22 and 38.

The second end 80 of the inner cylindrical tube 76 is substantially sealed to the portion of wall 22 in which the communication opening 56 is formed. For example, as shown in FIG. 8, the second end 80 of the inner cylindrical tube 76 may extend at least partially into first communication opening 56. However, as noted above in relation to heat exchanger 10, the second end 80 does not necessarily extend into opening 56. The second end 80 of tube 76 in FIG. 8 is not sealed to plate 38 and/or first communication opening 57 of plate 38, but rather is spaced therefrom.

As mentioned above, a second space 52' is provided between wall 40 of the second fluid flow passage 36 and wall 66 of the third fluid flow passage 65. Therefore, the second wall 40 of the second fluid flow passage 36 may be provided with a communication opening 56', which may correspond in dimensions and location to communication opening 56, and which is aligned with openings 56 and 57.

Bridging the first space 52 is a first spacer 120 having a hollow interior, a first end 122 forming a sealed connection with the wall 22 in which opening 56 is formed, and a second end 124 forming a sealed connection with the wall 38 in which opening 57 is formed.

For example, as shown in FIG. 8, first spacer 120 is in the form of an annular ring comprising an inner cylindrical side wall 126, an outer cylindrical side wall 128 spaced from the inner side wall 126, and a bridging portion 130 extending between and connecting the side walls 126, 128 together. In the embodiments shown in the drawings, the side walls 126, 128 and the bridging portion 130 have a U-shaped appearance in cross-section. The second end 124 of spacer 120 may have a shoulder 125 which permits the spacer 120 to seat inside the first communication opening 57 in the first wall 38 of the second fluid flow passage 36, thereby locating the spacer 120 relative to the communication opening 57. The planar surface of spacer 120 surrounding the shoulder 125 forms an annular sealing surface 64 at which the spacer 120 is sealingly connected to the first wall 38 of second fluid flow passage 36, in an area surrounding the first communication opening 57, for example by welding or brazing. As with the shoulder 106 of the inlet/outlet fitting 70, the shoulder 125 of the spacer 120 may have a diameter which is smaller than the diameter of first communication opening 57 by an amount sufficient to permit proper alignment of the spacer relative to openings 56, 57 notwithstanding any stack-up tolerance variation.

In an embodiment, the side walls 126, 128 and bridging portion 130 may be of unitary construction, and may be comprised of aluminum or an aluminum alloy.

A resilient sealing member in the form of a sealing ring 132 is received inside the spacer 120, and is located in the annular space between the inner and outer side walls 126, 128. The resilient sealing ring 132 provides a resilient seal between the first end 122 of spacer 120 and the wall 22 of the first flow passage 20. In particular, the resilient seal is formed between the first end 122 of the spacer 120 and the adjacent first portion 12 of heat exchanger 10. In the illustrated embodiment, the surface of plate 22 facing the spacer 120 is provided with an annular groove 134 surrounding the first communication opening 56 in plate 22. The annular groove is formed within the thickness of wall 22.

The resilient sealing member 132 has an annular, generally cylindrical shape, with a first end received inside the annular groove 134 of wall 22 and a second end received inside the spacer 120 and in engagement with the bridging portion 130. In the embodiment shown in FIG. 8, the resilient sealing member 132 has a rectangular cross-section.

As can be seen in FIG. 8, the resilient sealing member 132 may have a thickness (measured in radial direction) which is less than the distance between the inner and outer side walls 126, 128 of spacer 120. This permits some lateral adjustment of the first and second portions 12, 14 of heat exchanger 10 relative to one another, so as to avoid misalignment caused by the stack-up tolerance variation.

The heat exchanger 200 will include an opposite end which is remote from the inlet/outlet fitting 70, corresponding to the portion of heat exchanger 10 shown in FIG. 4. The first, second and third portions 12, 14, 16 may also be spaced apart at this end of heat exchanger 10, and spacers 120 may also be provided at this end of heat exchanger 200 to provide sealed connections between portions 12, 14, 16 in the same manner as discussed above in relation to the fitting end of the heat exchanger 200.

As shown in FIG. 8, the first and second flow passages 20, 36 may be provided with turbulence-enhancing inserts 140, each of which may comprise a fin or a turbulizer. In addition, turbulence-enhancing inserts can be provided in the space 52 between the heat exchanger portions 12, 14.

As mentioned above, a second space 52' is provided between portions 14 and 16 of heat exchanger 200, more specifically between wall 40 of the second fluid flow passage 36 and wall 66 of the third fluid flow passage 65. A spacer 120' and a resilient member 132' are provided in this space 52'. The spacer 120' and resilient member 132' may be identical to spacer 120 and resilient member 132 described above, however, FIG. 8 illustrates some minor variations which may be incorporated into the spacer 120' and seal 132'.

In this regard, the resilient sealing member 132' has a cross-sectional shape which differs from that of resilient sealing member 132. The resilient sealing member 132' has an outer rib 136 and an inner rib 138 which reduce the size of the gap between the resilient sealing member 132' and the side walls 126', 128' of spacer 120'. The ribs 136, 138 provide the resilient sealing member 132' with an approximate cross or t-shape, and reduce the potential for lateral misalignment. The inventors have found that the use of resilient sealing member 132' having this profile provides accurate alignment of the second and third portions 14, 16 of heat exchanger 200, while avoiding excessive compressive forces.

Another variation illustrated in FIG. 8 relates to the annular groove in which the first end of the resilient sealing member 132' is received. As shown, an annular rib 142 is provided in the area of wall 40 surrounding communication opening 56', and protrudes into the second fluid flow passage 36. The rib 142 may be formed by stamping the wall 40. An annular groove 134' is provided in the underside of annular rib 142, the groove 134' receiving the first end of the resilient sealing member 132'.

Although FIG. 8 shows a gap between the first end 122 of spacer 120 and the wall 22 of the first portion 12 of heat exchanger 200, this is not necessarily the case. Rather, the heat exchanger 200 may be under sufficient compression that the first end 122 of spacer 120 is in contact with wall 22, and thus acts as a "hard stop" to prevent over compression of the resilient member 132.

Although the invention has been described in connection with certain embodiments, it is not restricted thereto. Rather, the invention includes all embodiments which may fall within the scope of the following claims.

What is claimed is:

1. A heat exchanger comprising:

at least a first enclosed fluid flow passage and a second enclosed fluid flow passage, wherein each of the fluid flow passages is defined between a first wall and a second wall;

first and second communication openings provided in the first wall of each of the first and second flow passages, wherein the first communication opening of the first flow passage aligns with the first communication opening of the second flow passage and the second communication opening of the first flow passage aligns with the second communication opening of the second flow passage;

an inlet/outlet opening provided in the second wall of the first flow passage, wherein the inlet/outlet opening is aligned with the first communication opening in the first wall of the first flow passage;

an inlet/outlet fitting received in the inlet/outlet opening, wherein the inlet/outlet fitting has an inner tubular passage surrounded by an outer annular passage, wherein the inner tubular passage is defined by an inner cylindrical tube having a first end and a second end, wherein the inlet/outlet fitting further comprises an outer annular ring having a first end and a second end, wherein the outer annular ring surrounds the inner cylindrical tube and is connected thereto, and wherein the outer annular passage is defined between the inner cylindrical tube and the outer annular ring;

wherein the second end of the outer annular ring has a planar sealing surface surrounding the outer annular passage, and wherein the planar sealing surface of the outer annular ring is sealingly connected to an area of the second wall of the first flow passage surrounding the inlet/outlet opening, such that the first flow passage is in fluid flow communication with the outer annular passage of the inlet/outlet fitting;

wherein the second end of the inner cylindrical tube extends through the first flow passage and is in sealed fluid flow communication with the second flow passage, such that the second flow passage is in fluid flow communication with the inner tubular passage of the inlet/outlet fitting;

wherein the first and second flow passages are defined by respective first and second plate pairs, each of the plate pairs comprising a pair of plates sealed together at their edges, and wherein the first plate includes the first wall and the second plate includes the second wall, and wherein the inlet/outlet opening is substantially concentrically aligned with the first communication openings in each of the first and second flow passages;

wherein the planar sealing surface of the outer annular ring has an annular shape, with an outer peripheral edge and an inner peripheral edge, wherein a diameter of the planar sealing surface at the outer peripheral edge is greater than a diameter of the inlet/outlet opening, and wherein a diameter of the planar sealing surface at the inner peripheral edge is less than the diameter of the inlet/outlet opening;

wherein the second end of the outer annular ring comprises a shoulder located at the inner peripheral edge of the planar sealing surface and outwardly from the outer annular passage, wherein the shoulder has a diameter which is smaller than the diameter of the inlet/outlet opening, and is received inside the inlet/outlet opening; and wherein the diameter of the shoulder differs from the diameter of the inlet/outlet opening by an amount which is at least as great as a stack-up tolerance variation of the heat exchanger.

2. The heat exchanger of claim 1, wherein the first end of the inner cylindrical tube extends beyond the first end of the outer annular ring and has an outer surface provided with a first resilient sealing member for sealing the first end of the inner cylindrical tube within a first inner bore of a fluid opening; and wherein the outer annular ring has a cylindrical outer surface provided with a second resilient sealing member for sealing the cylindrical outer surface of the annular ring within a second inner bore of said fluid opening, wherein the first inner bore and the second inner bore are concentric with one another.

3. The heat exchanger of claim 2, wherein the first resilient sealing member and the second resilient sealing member each comprise an O-ring.

4. The heat exchanger of claim 1, wherein the outer annular ring is integrally formed with the inner cylindrical tube, and wherein the outer annular ring is rigidly connected to the inner cylindrical tube through a plurality of webs, such that the outer annular ring is concentric with the inner cylindrical tube.

5. The heat exchanger of claim 1, wherein the second end of the inner cylindrical tube has an outer cylindrical surface having a diameter which is less than a diameter of the first communication opening in the first wall of the first flow passage, and wherein the outer cylindrical surface of the inner cylindrical tube is sealed to the first wall of the first flow passage.

6. The heat exchanger of claim 5, wherein the outer cylindrical surface of the inner cylindrical tube is sealed to an inner peripheral surface of the first communication opening of the first flow passage.

7. The heat exchanger of claim 5, wherein the outer cylindrical surface of the inner cylindrical tube is sealed to the first wall of the first flow passage by brazing or welding.

8. The heat exchanger of claim 1, wherein the first wall of the first flow passage is in engagement with the first wall of the second flow passage, and wherein the first communication openings of the first and second flow passages are in substantial concentric alignment with one another.

9. The heat exchanger of claim 8, wherein the second end of the inner cylindrical tube extends at least partially through the first communication opening in the first wall of the second flow passage.

10. The heat exchanger of claim 9, wherein the second end of the inner cylindrical tube is sealed to the first wall of the second flow passage within the first communication opening of the second flow passage.

11. The heat exchanger of claim 1, wherein a space is provided between the first wall of the first flow passage and the first wall of the second flow passage.

12. The heat exchanger of claim 11, wherein a spacer is provided in the space between the first wall of the first flow passage and the first wall of the second flow passage, wherein the spacer comprises:

a hollow interior;

a first end forming a sealed connection with the first wall of the first flow passage in an area surrounding the first communication opening of the first flow passage; and a second end forming a sealed connection with the first wall of the second flow passage in an area surrounding the first communication opening of the second flow passage.

13. The heat exchanger of claim 12, wherein the spacer comprises an annular ring having an inner cylindrical side wall, an outer cylindrical side wall spaced from the inner cylindrical side wall, and a bridging portion extending between and connecting the side walls together, wherein the inner cylindrical side wall, the outer cylindrical side wall and the bridging portion together define the hollow interior of the spacer.

14. The heat exchanger of claim 13, wherein the inner and outer cylindrical side walls and the bridging portion of the spacer have a U-shaped appearance in cross-section, and wherein the second end of the spacer includes a shoulder which is received inside the first communication opening in the first wall of the second fluid flow passage.

15. The heat exchanger of claim 12, wherein the spacer further comprises a resilient sealing member in the form of a sealing ring received inside the hollow interior.

16. The heat exchanger of claim 15, wherein the first wall of the first flow passage has an annular groove surrounding the first communication opening formed therein, and wherein the resilient sealing member has a first end received inside the annular groove and a second end received inside the hollow interior of the spacer, in engagement with the bridging portion.

* * * * *